US008079224B2

(12) United States Patent
Dicken et al.

(10) Patent No.: US 8,079,224 B2
(45) Date of Patent: Dec. 20, 2011

(54) FIELD INTEGRATED PULSE TUBE CRYOCOOLER WITH SADA II COMPATIBILITY

(75) Inventors: Lane Daniel Dicken, Davenport, IA (US); Arthur R. Nelson, Davenport, IA (US); Dennis Eugene Lund, Jr., Bettendorf, IA (US); Daniel James Belk, Long Grove, IA (US); Mark Russell Squires, Davenport, IA (US)

(73) Assignee: Carleton Life Support Systems, Inc., Davenport, IA (US)

( * ) Notice: Subject to any disclaimer, the term of this patent is extended or adjusted under 35 U.S.C. 154(b) by 1041 days.

(21) Appl. No.: 11/954,917

(22) Filed: Dec. 12, 2007

(65) Prior Publication Data

US 2009/0151364 A1 Jun. 18, 2009

(51) Int. Cl.
*F25B 9/00* (2006.01)

(52) U.S. Cl. ..... 62/6; 62/55.5

(58) Field of Classification Search ..... 62/6, 51.1, 62/55.5, 600, 634, 520
See application file for complete search history.

(56) References Cited

U.S. PATENT DOCUMENTS 5,613,365 A 3/1997 Mastrup et al.
6,374,617 B1 * 4/2002 Bonaquist et al. ..... 62/6
7,114,341 B2 * 10/2006 Gao ..... 62/6
2002/0152758 A1 * 10/2002 Longsworth ..... 62/6
2006/0144054 A1 7/2006 Xu et al.
2006/0156741 A1 7/2006 Kirkconnell

FOREIGN PATENT DOCUMENTS

EP 0 614 059 A 9/1994
EP 0 717 245 A 6/1996

OTHER PUBLICATIONS

Thales Cryocoolers Product Sheets; www.thales-cryogenics.com; USA.
Raytheon; "Standard Advanced Dewer Assembly II (SADAII)"; Product Information Sheet; USA.
Carleton Life Support Systems Inc; Model LC1047 Product Information Sheet; USA.
WIKIPEDIA.ORG; Pulse Tube Cryocooler; Jul. 5, 2008; USA.
Ray Radebaugh, "Development of the Pulse Tube Refrigerator as an Efficient and Reliable Cryocooler"; USA.
H. Korf, I. Ruhlich, M. Mai, G. Thummes; "Pulse Tube Cryocooler for IR Applications"; 2005; Germany.

* cited by examiner

*Primary Examiner* — Melvin Jones
(74) *Attorney, Agent, or Firm* — Woods Oviatt Gilman LLP; Katherine H. McGuire, Esq.

(57) ABSTRACT

A unitary pulse tube expander for removable attachment to a SADA II coldfinger and insertion within a Dewar assembly. The regenerator of the pulse tube expander is encased in a regenerator sleeve and a cold cap to create a unitary pulse tube expander that may function as a drop-in replacement for a Stirling type expander in a SADA II coldfinger cryocooler.

6 Claims, 3 Drawing Sheets

FIELD INTEGRATED PULSE TUBE CRYOCOOLER WITH SADA II COMPATIBILITY

TECHNICAL FIELD

The present invention relates to a coldfinger cryocooler for cooling electronic components such as infrared sensors. More particularly, the present invention relates to a unitary pulse tube cryocooler that is configured as a drop-in replacement for a Stirling displacer-type expander in a coldfinger cryocooler.

BACKGROUND OF THE INVENTION

Many electronic components (e.g., infrared sensors) must be cooled to cryogenic temperatures to operate. Infrared sensors and associated electronics are often contained in a vacuum sealed housing commonly known as a Dewar assembly. The cryocooler assembly includes a "coldfinger" which has heat exchangers defining a cold end and an opposite warm end, and an expander removably positioned and extending between the warm and cold ends of the coldfinger. The expander includes a regenerator which operates to transfer heat from the cold end region to the warm end region of the expander while the cryocooler operates.

Standard Advanced Dewar Assembly II (SADA II) is a military standard that requires a coldfinger type cryocooler to have a specific geometry to allow "in-the field" integration into a Dewar assembly (e.g. at the Dewar/sensor manufacturer's facility). The expander must therefore be unitary to allow it to be "dropped-in" to the coldfinger by the Dewar/sensor manufacturer. Dewar/sensor manufacturers therefore often require cryocooler manufacturers to provide cryocoolers that are compliant with the SADA II standard.

One technology used in cryocoolers is known as a split Stirling cryocooler which comprises a rigid cylinder with an internal moving regenerator component that oscillates through a fixed quantity of working gas within the cylinder in response to pressure oscillations from an external compressor. As the regenerator component moves, gas is alternately compressed and expanded with the heat of compression being transferred from a "cold" heat exchanger located at the cold end of the expander to "hot" heat exchangers located at the warm end of the expander. When the cryocooler is installed in a Dewar assembly, the cold end is positioned closely adjacent or against the sensor to be cooled. Heat is removed from the cryocooler system at the "hot" heat exchangers in the warm end region of the pulse tube expander.

The Stirling regenerator and cold end heat exchanger are encased in a rigid cylinder to provide a unitary, self contained, cylindrical expander. The "warm end" of the expander attaches to the cooling head which includes the appropriate connections and tubing leading to a cryocooler compressor and buffer. The "cold end" of the expander extends outwardly therefrom and is inserted into the SADA II coldfinger which thereby completes the cryocooler assembly for shipment to the Dewar/sensor manufacturer. The coldfinger closes off the cryocooler unit to the ambient allowing the cryocooler unit to be charged with an inert gas which keeps the cryocooler clean during handling and shipment to the Dewar/sensor manufacturer.

It is common practice for the Dewar/sensor manufacturer to have already welded a SADA II coldfinger into their Dewar housing. Thus, upon receiving the cryocooler from the cryocooler manufacturer, the Dewar/sensor manufacturer must first remove the SADA II coldfinger from the cryocooler unit as shipped prior to attachment to the coldfinger/Dewar assembly. With the "shipped" SADA II coldfinger removed, the Dewar/sensor manufacturer inserts the now exposed expander cold end into the SADA II coldfinger which has been previously welded into the Dewar. The SADA II coldfinger which came attached to the cryocooler is shipped back to the cryocooler manufacturer for re-use.

While Stirling type expanders benefit from the fact they are unitary, the fact that their regenerator is a moving component is undesirable in that the movement can create unwanted system vibrations and potential mechanical failure points. It would therefore be desirable to have a unitary pulse tube expander with no moving parts that can act as a drop-in replacement for Stirling expanders in a SADA II coldfinger.

SUMMARY OF THE INVENTION

The present invention addresses the above need by providing a uniquely configured pulse tube expander with no moving parts which may be used as a drop-in replacement for a Stirling type expander in a SADA II coldfinger. By "drop-in replacement", it is meant that the pulse tube expander of the present invention may removably attach to a SADA II coldfinger in the same manner and with the same ease as a Stirling type expander. Before the present invention, this has not been possible due to the fact that pulse tube expanders are typically "built-up" and not available in unitary form.

The inventive pulse tube expander includes a cylindrical pulse tube having an inner diameter that defines a central bore and an outer diameter upon which a regenerator (e.g., comprising a stack of punched discs) is mounted. The regenerator is mounted in contacting, coaxial relationship about the pulse tube.

A regenerator sleeve is placed in preferably coaxial relationship about the regenerator. The pulse tube expander further includes a cold cap mounted to a cold end of the pulse tube which is located opposite a warm end thereof. The cold cap covers the opening defined by the edges of the regenerator sleeve to enclose the regenerator and tube and thereby form a rigid, cylindrically shaped pulse tube body having outer surfaces defined by the regenerator sleeve, the cold cap, and the warm end region of the expander to which the pulse tube is connected. Thus, a unitary, rigid, pulse tube expander is formed for drop-in insertion into a SADA II coldfinger.

The pulse tube expander of the present invention may thus operate as a drop-in replacement for a Stirling type expander in a coldfinger in the field. The functionality of field integration, together with no moving parts and adherence to mechanical tolerances specified by the military standard SADA II, renders the pulse tube expander of the present invention as a desirable drop-in replacement for Stirling type expanders in SADA II coldfingers and Dewar assemblies.

BRIEF DESCRIPTION OF THE DRAWINGS

The present invention will be better understood by referring to the drawings wherein.

DETAILED DESCRIPTION OF A PREFERRED EMBODIMENT OF THE INVENTION

Figure 1:
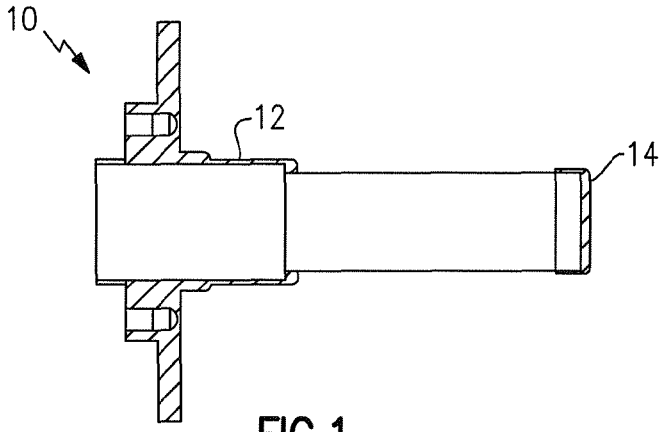
FIG. 1 is a cross sectional view of a prior art SADA II coldfinger
Figure 2:
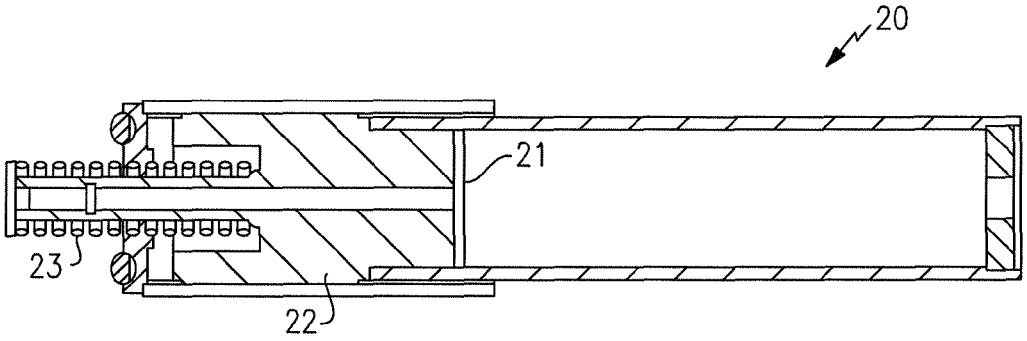
FIG.2 Prior Art
FIG. 2 is a cross sectional view of a prior art Stirling expander.
Figure 3:
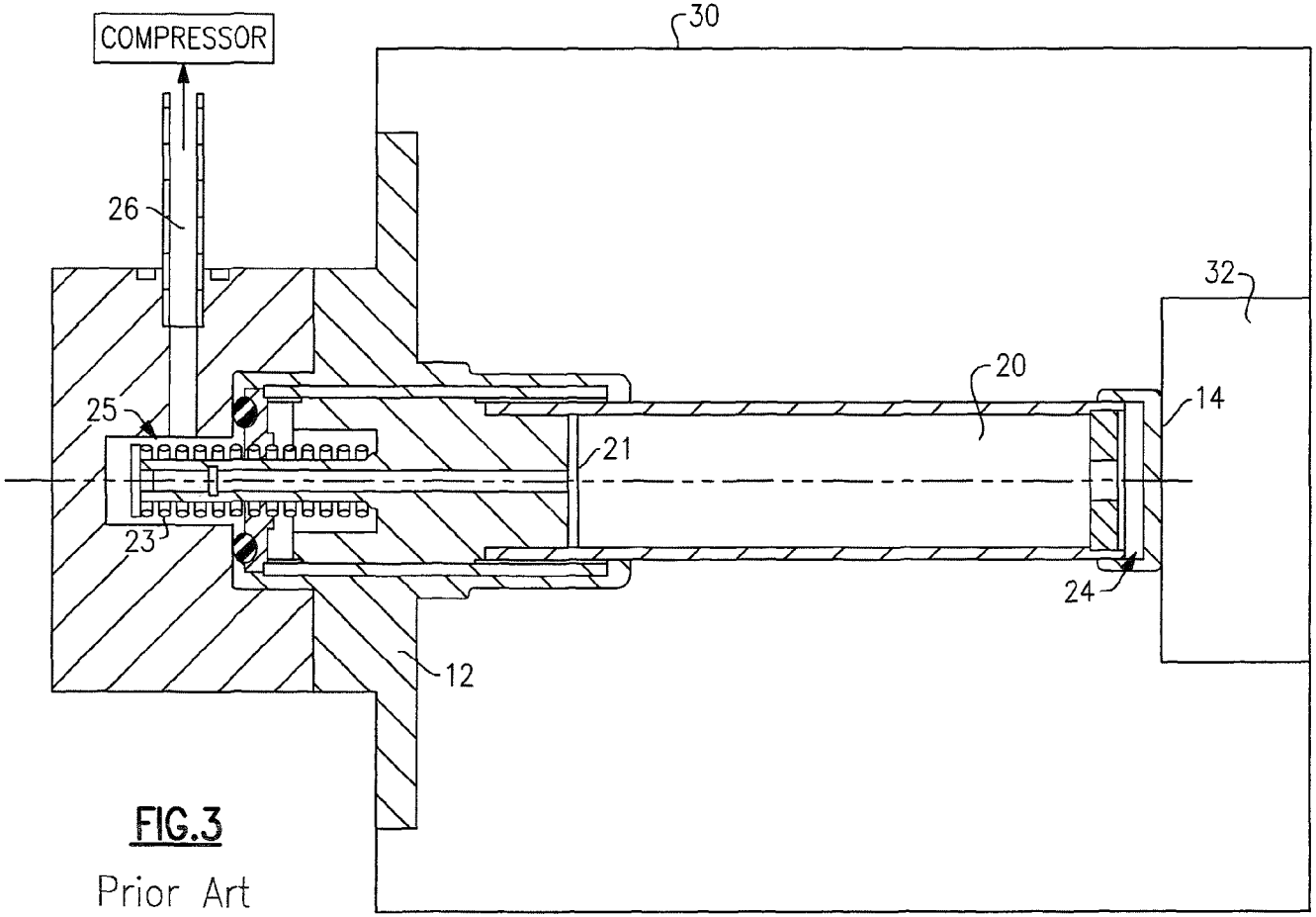
FIG.3 Prior Art
FIG. 3 is a cross sectional view the prior art Stirling expander of FIG. 2 incorporated into the SADA II coldfinger of FIG. 1 and Dewar assembly.

Referring now to the drawings, there is seen in FIG. 1 a prior art SADA II coldfinger 10 having a warm end 12 and a cold end cap 14. The SADA II coldfinger is configured with SADA II military standard dimensions to permit attachment to an expander such as the prior art Stirling expander 20 seen in FIGS. 2 and 3. As explained above, the Dewar/sensor manufacturer typically welds a SADA II coldfinger 10 to the Dewar 30 adjacent the electronics 32 to be cooled (FIG. 3). Upon receiving the cryocooler from the cryocooler manufacturer, the Dewar/sensor manufacturer removes the SADA II coldfinger which was shipped with the cryocooler. With the SADA II coldfinger thus removed, the now exposed expander is then inserted into the SADA II coldfinger in the Dewar 30

As known to those skilled in the art, Stirling expander 20 includes a moving regenerator 21, a clearance seal 22, and spring 23. When attached to the coldfinger 10, an expansion space 24 is created adjacent coldfinger cold end 14 and a compression space 25 is created adjacent spring 23. A transfer line 26 is connected to a compressor (not shown) to drive the cooler. Pressure oscillations from the compressor induce phased oscillations in the moving regenerator 21. With the proper phase relationship in place, cooling is created by the expanding gas in expansion space 24, and heat is rejected by the compressed gas in the compression space 25.

As explained above, a Stirling type expander as shown in FIGS. 2 and 3 has drawbacks due to the presence of moving regenerator 21 which creates the need for clearance seals which must have tight tolerances and kept free of contamination. The moving regenerator is also a source of vibration and a point for mechanical fatigue and failure.

Figure 4:
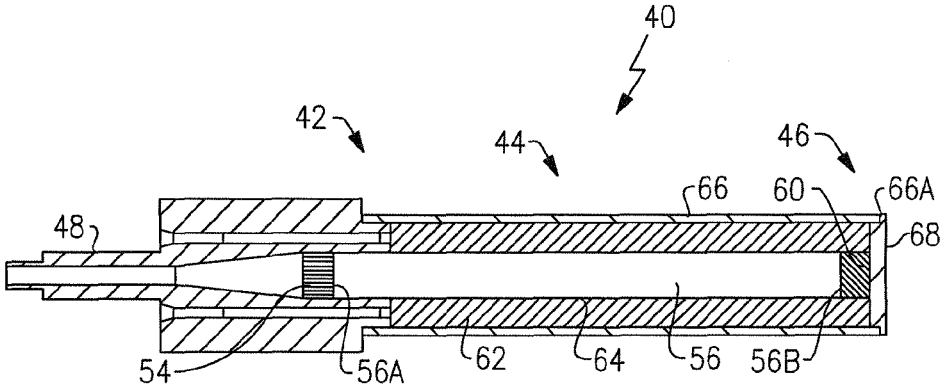
FIG. 4 is a cross sectional view of an embodiment of a pulse tube expander in accordance with an embodiment of the present invention.
Figure 5:
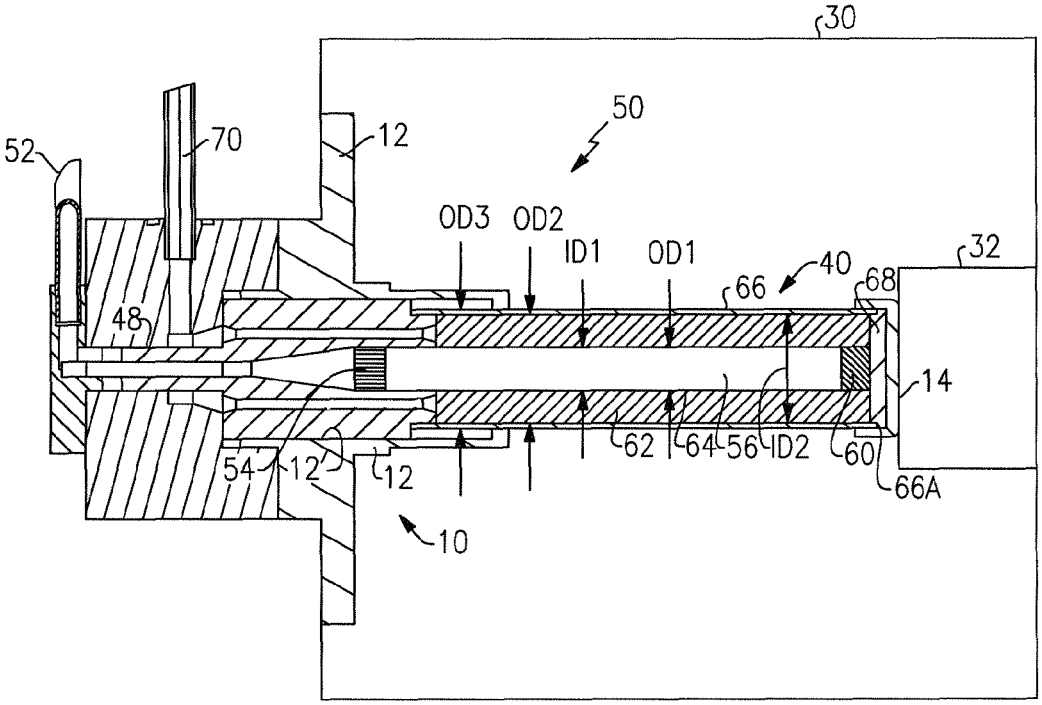
FIG. 5 is a cross sectional view of the pulse tube expander of FIG. 4 incorporated into a SADA II coldfinger and Dewar assembly.

As seen in FIGS. 4 and 5, pulse tube expander 40 generally includes a warm end region 42, a central region 44, and a cold end region 46. Warm end region 42 includes a connector portion 48 that extends through coldfinger warm end 12 to communicate along line 52 with a buffer volume which contains a reservoir of working fluid (e.g., helium). Warm end region 42 may also include hot heat exchangers 54 which operate to remove heat from warm end region 42 while cryocooler unit 50 is in operation as is well understood by those skilled in the art.

Central region 44 includes a cylindrical pulse tube 56 having first and second ends 56*a*, 56*b*, respectively. Hot heat exchanger 54 is disposed at first end 56*a* adjacent warm end region 42 of pulse tube expander 40 and a "cold" heat exchanger 60 is disposed at second end 56*b* adjacent cold end region 46 of pulse tube expander 40.

An annular regenerator 62 having an inner diameter ID1 is sized to coaxially mount to and contact an outer surface 64 having an outer diameter OD1 of pulse tube 56. Regenerator 62 generally extends from warm end region 42 to cold end region 46 of pulse tube expander 40. Regenerator 62 preferably comprises a plurality of stacked metallic, mesh discs 62, each having a central hole which align to define a bore through which pulse tube 56 axially extends, although other types and configurations of regenerators are of course possible.

A regenerator sleeve 66 having an inner diameter ID2 is sized to coaxially mount to and contact an outer diameter OD2 of regenerator 62. Sleeve 66 preferably extends from warm end region 42 to cold end region 46 to a distance slightly beyond pulse tube 56. A cold cap 68 is positioned over an opening defined at end 66*a* of regenerator sleeve 66 to thereby encase pulse tube 56 and regenerator 62 and define a unitary body which may then be simply attached to a SADA II coldfinger 10 in the same manner as a Stirling expander 20. This is made possible by forming the outer surfaces at warm end region 42 of pulse tube expander 40 to match the internal geometry of cold finger cold end 12. Furthermore, the regenerator sleeve 66 provides a very reproducible outer diameter dimension that is easily matched to the SADA II geometry requirements. As such, expander 40 may be removably attached to and extend between coldfinger cold end 12 and cold end cap 14 to form cryocooler unit 50. Unit 50 may then be charged with an inert gas for safe shipment to the Dewar/sensor manufacturer. Once received, the Dewar/sensor manufacturer removes the SADA II coldfinger shipped with the unit 50 and inserts the now exposed expander 40 into the SADA II coldfinger previously welded into the Dewar 30 as seen in FIG. 5.

It will thus be appreciated the invention provides a unitary pulse tube type expander which may be easily attached to a SADA II coldfinger in the same manner as Stirling-type expanders. While the invention has been described herein with reference to preferred embodiments thereof, it will be appreciated that modifications may be made thereto without departing from the full spirit and scope of the invention as defined by the claims which follow.

What is claimed is:

1. A unitary pulse tube expander configured as a drop-in replacement for a Stirling expander in a SADA II coldfinger, said pulse tube expander comprising:

a) a pulse tube having first and second ends;

b) a regenerator positioned about said pulse tube;

c) a regenerator sleeve placed in about said regenerator, said regenerator sleeve having an outer diameter; and d) a cold cap positioned over said pulse tube second end, whereby said regenerator sleeve outer diameter is sized for removable attachment of said pulse tube expander to a SADA II coldfinger.

2. The pulse tube expander of claim 1, and further comprising a hot heat exchanger mounted adjacent said pulse tube first end and a cold heat exchanger mounted adjacent said pulse tube second end.

3. The pulse tube expander of claim 1 wherein said regenerator comprises a plurality of stacked mesh discs.

4. The pulse tube expander of claim 1 wherein said pulse tube, said regenerator and said regenerator sleeve are in coaxial alignment with one another.

5. A method of shipping a pulse tube expander and SADA II coldfinger to a Dewar/sensor manufacturer, said method comprising the steps of:

a) providing a unitary pulse tube expander having a regenerator sleeve and cold end cap sized to removably attach to a SADA II coldfinger;

b) removably attaching said unitary pulse tube expander to said SADA II coldfinger and thereby closing the interior of said pulse tube expander off to the ambient;

c) charging said unitary pulse tube expander and SADA II coldfinger with an inert gas; and d) shipping said unitary pulse tube expander and said SADA II coldfinger to a Dewar/sensor manufacturer.

6. The method of claim 5, and further comprising the steps of:

a) removing said shipped SADA II coldfinger from said pulse tube expander; and b) attaching said pulse tube expander to another SADA II coldfinger which has been previously attached to a Dewar assembly.

* * * * *